US010292002B2

(12) United States Patent
Patel

(10) Patent No.: US 10,292,002 B2
(45) Date of Patent: May 14, 2019

(54) SYSTEMS AND METHODS FOR DELIVERY OF PERSONALIZED AUDIO

(71) Applicant: Disney Enterprises, Inc., Burbank, CA (US)

(72) Inventor: Mehul Patel, Stevenson Ranch, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 15/648,251

(22) Filed: Jul. 12, 2017

(65) Prior Publication Data

US 2017/0311108 A1 Oct. 26, 2017

Related U.S. Application Data

(63) Continuation of application No. 15/284,834, filed on Oct. 4, 2016, now Pat. No. 9,736,615, which is a (Continued)

(51) Int. Cl.
*H04R 3/00* (2006.01)
*H04R 5/00* (2006.01)

(Continued)

(52) U.S. Cl.
CPC ..... *H04S 7/303* (2013.01); *G10K 11/175* (2013.01); *H04R 3/12* (2013.01); *H04R 5/02* (2013.01);

(Continued)

(58) Field of Classification Search
CPC ... H04R 3/00; H04R 3/12; H04R 5/00; H04R 5/02; H04R 5/04; H04R 2203/12; H04S 2400/01; H04S 2400/11; H04S 2400/13; H04S 2420/01; H04S 7/30; H04S 7/301; H04S 7/302; H04S 7/303; H04S 7/307; G10K 11/175; G06F 3/165
See application file for complete search history.

(56) References Cited

U.S. PATENT DOCUMENTS

2003/0031333 A1* 2/2003 Cohen ..... H04S 7/301 381/303
2007/0263889 A1* 11/2007 Melanson ..... H04S 7/301 381/300

(Continued)

FOREIGN PATENT DOCUMENTS

EP 1 699 259 9/2006
JP 2009-531926 9/2009

(Continued)

*Primary Examiner* — Thang V Tran
(74) *Attorney, Agent, or Firm* — Farjami & Farjami LLP

(57) ABSTRACT

There is provided a media device for use in a system including a plurality of speakers. The media device includes a memory configured to store a software application, and a processor. The processor is configured to execute the software application to transmit one or more audio calibration signals to the plurality of speakers for emission of sounds by the plurality of speakers in an environment, receive, from a user device, information relating to a detection of the one or more audio calibration signals detected by the user device, and analyze the information received from the user device to determine how the sounds travel in the environment.

20 Claims, 4 Drawing Sheets

Related U.S. Application Data continuation of application No. 14/805,405, filed on Jul. 21, 2015, now Pat. No. 9,686,625.

(51) Int. Cl.

| | |
|---|---|
| ***H04S 7/00*** | (2006.01) |
| ***G10K 11/175*** | (2006.01) |
| ***H04R 3/12*** | (2006.01) |
| ***H04R 5/02*** | (2006.01) |
| ***H04R 5/04*** | (2006.01) |

(52) U.S. Cl.

CPC ..... *H04R 5/04* (2013.01); *H04R 2203/12* (2013.01); *H04S 2400/01* (2013.01)

(56) References Cited

U.S. PATENT DOCUMENTS

2008/0063211 A1* 3/2008 Kusunoki ..... H04R 3/12 381/18
2009/0010455 A1* 1/2009 Suzuki ..... H04R 1/403 381/97
2011/0116641 A1* 5/2011 Bergere ..... H04S 3/00 381/17
2013/0142337 A1 6/2013 Troughton
2013/0216071 A1* 8/2013 Maher ..... H04R 3/04 381/303
2014/0219483 A1* 8/2014 Hong ..... H04R 5/02 381/307
2015/0078595 A1 3/2015 Shintani
2015/0243297 A1* 8/2015 Benway ..... G10L 21/0208 704/226
2015/0382128 A1* 12/2015 Ridihalgh ..... H04S 7/301 381/57

FOREIGN PATENT DOCUMENTS

JP 2012-217015 11/2012
JP 2015-056905 3/2015
WO WO 2007/113718 10/2007

* cited by examiner

SYSTEMS AND METHODS FOR DELIVERY OF PERSONALIZED AUDIO

This application is a Continuation of U.S. application Ser. No. 15/284,834, filed Oct. 4, 2016, which is a Continuation of U.S. application Ser. No. 14/805,405, filed Jul. 21, 2015, now U.S. Pat. No. 9,686,625, which are hereby incorporated by reference in its entirety.

BACKGROUND

The delivery of enhanced audio has improved significantly with the availability of sound bars, 5.1 surround sound, and 7.1 surround sound. These enhanced audio delivery systems have improved the quality of the audio delivery by separating the audio into audio channels that play through speakers placed at different locations surrounding the listener. The existing surround sound techniques enhance the perception of sound spatialization by exploiting sound localization, a listener's ability to identify the location or origin of a detected sound in direction and distance.

SUMMARY

The present disclosure is directed to systems and methods for delivery of a personalized audio, substantially as shown in and/or described in connection with at least one of the figures, as set forth more completely in the claims.

DETAILED DESCRIPTION

Figure 1:
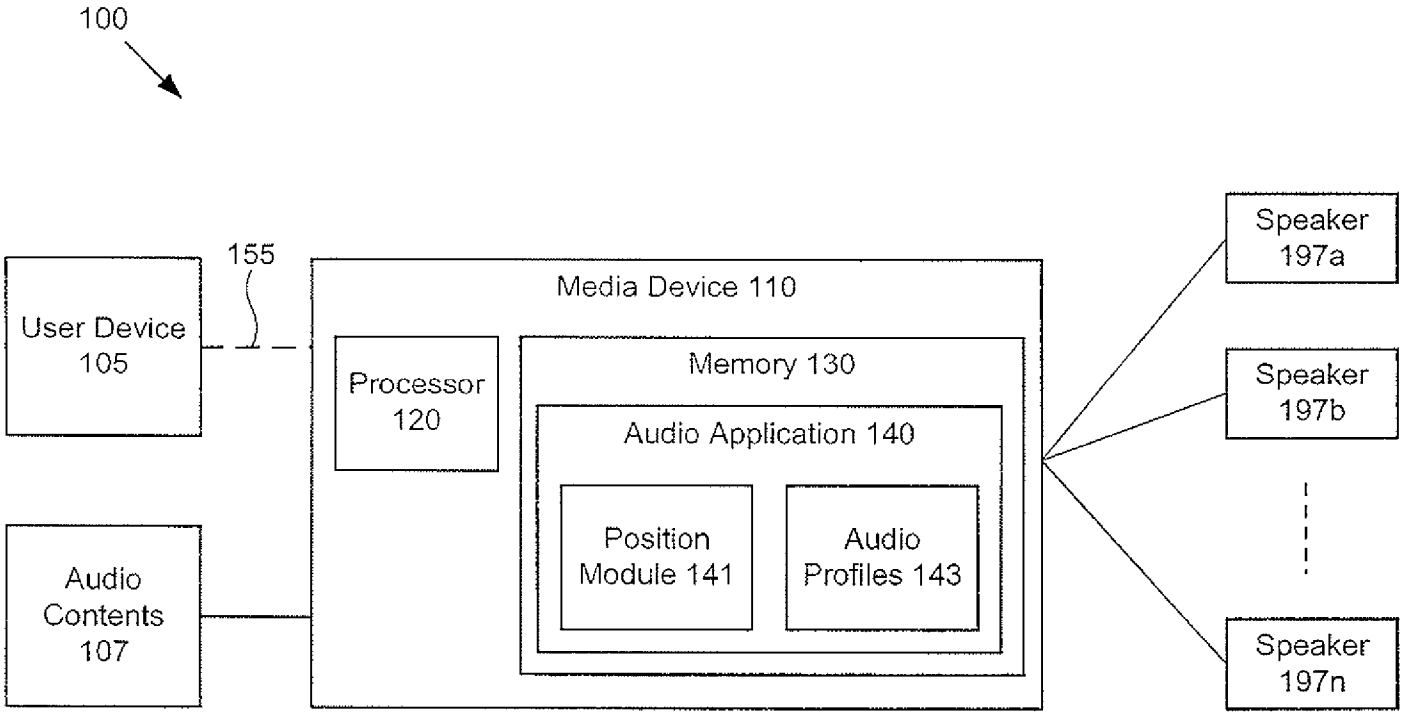
FIG. 1 illustrates an exemplary system for delivery of personalized audio, according to one implementation of the present disclosure.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1 shows exemplary system 100 for delivery of personalized audio, according to one implementation of the present disclosure. As shown, system 100 includes user device 105, audio contents 107, media device 110, and speakers 197*a*, 197*b*, . . . , 197*n*. Media device 110 includes processor 120 and memory 130. Processor 120 is a hardware processor, such as a central processing unit (CPU) used in computing devices. Memory 130 is a non-transitory storage device for storing computer code for execution by processor 120, and also storing various data and parameters.

User device 105 may be a handheld personal device, such as a cellular telephone, a tablet computer, etc. User device 105 may connect to media device 110 via connection 155. In some implementations, user device 105 may be wireless enabled, and may be configured to wirelessly connect to media device 110 using a wireless technology, such as Bluetooth, WiFi, etc. Additionally, user device 105 may include a software application for providing the user with a plurality of selectable audio profiles, and may allow the user to select an audio language and a listening mode. Dialog refers to audio of spoken words, such as speech, thought, or narrative, and may include an exchange between two or more actors or characters.

Audio contents 107 may include an audio track from a media source, such as a television show, a movie, a music file, or any other media source including an audio portion. In some implementations, audio contents 107 may include a single track having all of the audio from a media source, or audio contents 107 may be a plurality of tracks including separate portions of audio contents 107. For example, a movie may include audio content for dialog, audio content for music, and audio content for effects. In some implementations, audio contents 107 may include a plurality of dialog contents, each including a dialog in a different language. A user may select a language for the dialog, or a plurality of users may select a plurality of languages for the dialog.

Media device 110 may be configured to connect to a plurality of speakers, such as speakers 197*a*, speaker 197*b*, and speaker 197*n*. Media device 110 can be a computer, a set top box, a DVD player, or any other media device suitable for playing audio contents 107 using the plurality of speakers. In some implementations, media device 107 may be configured to connect to a plurality of speakers via wires or wirelessly.

In one implementation, audio contents 107 may be provided in channels, e.g. two-channel stereo, or 5.1-channel surround sound, etc. In other implementation, audio contents 107 may be provided in terms of objects, also known as object-based audio or sound. In such an implementation, rather than mixing individual instrument tracks in a song, or mixing ambient sound, sound effects, and dialog in a movie's audio track, those audio pieces may be directed to exactly go to one or more of speakers 197*a*-197*n*, as well as how loud they may be played. For example, audio contents 107 may be produced as metadata and instructions as to where and how all of the audio pieces play. Media device 110 may then utilize the metadata and the instructions to play the audio on speakers 197*a*-197*n*.

As shown in FIG. 1, memory 130 of media device 110 includes audio application 140. Audio application 140 is a computer algorithm for delivery of personalized audio, which is stored in memory 130 for execution by processor 120. In some implementations, audio application 140 may include position module 141 and audio profiles 143. Audio application 140 may utilize audio profiles 143 for delivering personalized audio to one or more listeners located at different positions relative to the plurality of speakers 197*a*, 197*b*, . . . , and 197*n*, based on each listener's personalized audio profile.

Audio application 140 also includes position module 141, which is a computer code module for obtaining a position of user device 105, and other user devices (not shown) in a room or theater. In some implementations, obtaining a position of user device 105 may include transmitting a calibration signal by media device 110. The calibration signal may include an audio signal emitted from the plurality of speakers 197*a*, 197*b*, and 197*n*. In response, user device 105 can use a microphone (not shown) to detect the calibration signal emitted from each of the plurality of speakers 197*a*, 197*b*, . . . , and 197*n*, and use a triangulation technique to determine a position of user device 105 based on its location relative to each of the plurality of speakers 197*a*, 197*b*, . . . , and 197*n*. In some implementations, position module 141 may determine a position of a user device 105 using one or more cameras (not shown) of system 100. As such, the position of each user may be determined relative to each of the plurality of speakers 197*a*, 197*b*, . . . , and 197*n*.

Audio application 140 also includes audio profiles 143, which includes defined listening modes that may be optimal for different audio contents. For example, audio profiles 143 may include listening modes having equalizer settings that may be optimal for movies, such as reducing the bass and increasing the treble frequencies to enhance playing of a movie dialog for a listener who is hard of hearing. Audio profiles 143 may also include listening modes optimized for certain genres of programming, such as drama and action, a custom listening mode, and a normal listening mode that does not significantly alter the audio. In some implementations, a custom listening mode may enable the user to enhance a portion of audio contents 107, such as music, dialog, and/or effects. Enhancing a portion of audio contents 107 may include increasing or decreasing the volume of that portion of audio contents 107 relative to other portions of audio contents 107. Enhancing a portion of audio contents 107 may include changing an equalizer setting to make that portion of audio contents 107 louder. Audio profiles 143 may include a language in which a user may hear dialog. In some implementations, audio profiles 143 may include a plurality of languages, and a user may select a language in which to hear dialog.

The plurality of speakers 197*a*, 197*b*, . . . , and 197*n* may be surround sound speakers, or other speakers suitable for delivering audio selected from audio contents 107. The plurality of speakers 197*a*, 197*b*, . . . , and 197*n* may be connected to media device 110 using speaker wires, or may be connected to media device 110 using wireless technology. Speakers 197 may be mobile speakers and a user may reposition one or more of the plurality of speakers 197*a*, 197*b*, . . . , and 197*n*. In some implementations, speakers 197*a*-197*n* may be used to create virtual speakers by using the position of speakers 197*a*-197*n* and interference between the audio transmitted from each speaker of speakers 197*a*-197*n* to create an illusion that sound is originating from a virtual speaker. In other words, a virtual speaker may be a speaker that is not physically present at the location from which the sound appears to originate.

Figure 2:
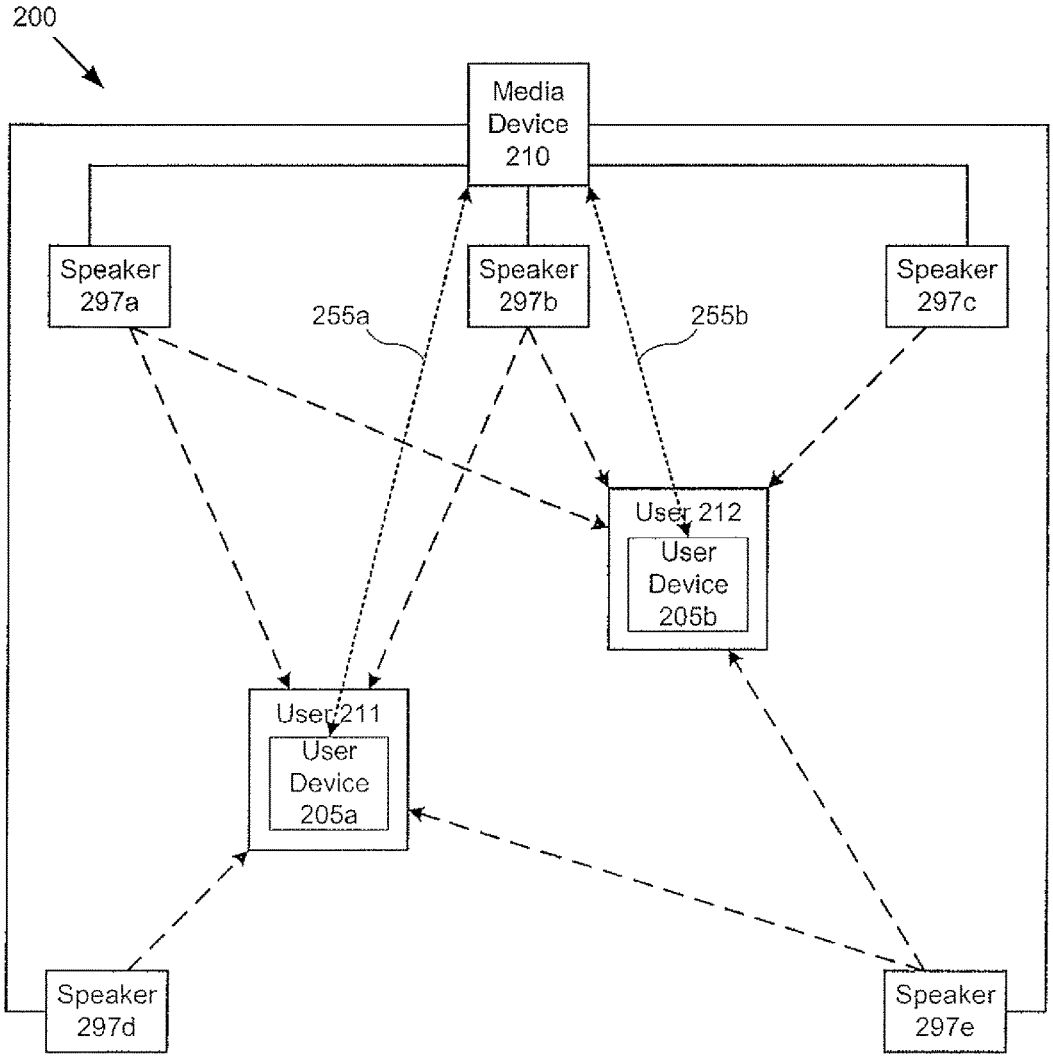
FIG. 2 illustrates an exemplary environment utilizing the system of FIG. 1, according to one implementation of the present disclosure.

FIG. 2 illustrates exemplary environment 200 utilizing system 100 of FIG. 1, according to one implementation of the present disclosure. User 211 holds user device 205*a*, and user 212 holds user device 205*b*. In some implementations, user device 205*a* may be at the same location as user 211, and user device 205*b* may be at the same location as user 212. Accordingly, when media device 210 obtains the position of user device 205*a* with respect to speakers 297*a*-297*e*, media device 210 may obtain the position of user 211 with respect to speakers 297*a*-297*e*. Similarly, when media device 210 obtains the position of user device 205*b* with respect to speakers 297*a*-297*e*, media device 230 may obtain the position of user 212 with respect to speakers 297*a*-297*e*.

User device 205*a* may determine a position relative to speakers 297*a*-297*e* by triangulation. For example, user device 205*a*, using a microphone of user device 205*a*, may receive an audio calibration signal from speaker 297*a*, speaker 297*b*, speaker 297*d*, and speaker 297*e*. Based on the audio calibration signals received, user device 205*a* may determine a position of user device 205*a* relative to speakers 297*a*-297*e*, such as by triangulation. User device 205*a* may connect with media device 210, as shown by connection 255*a*. In some implementations, user device 205*a* may transmit the determined position to media device 210. User device 205*b*, using a microphone of user device 205*b*, may receive an audio calibration signal from speaker 297*a*, speaker 297*b*, speaker 297*c*, and speaker 297*e*. Based on the audio calibration signals received, user device 205*b* may determine a position of user device 205*b* relative to speakers 297*a*-297*e*, such as by triangulation. In some implementations, user device 205*b* may connect with media device 210, as shown by connection 255*b*. In some implementations, user device 205*b* may transmit its position to media device 210 over connection 255*b*. In other implementations, user device 205*b* may receive the calibration signal and transmit the information to media device 210 over connection 255*b* for determination of the position of user device 205*b*, such as by triangulation.

Figure 3:
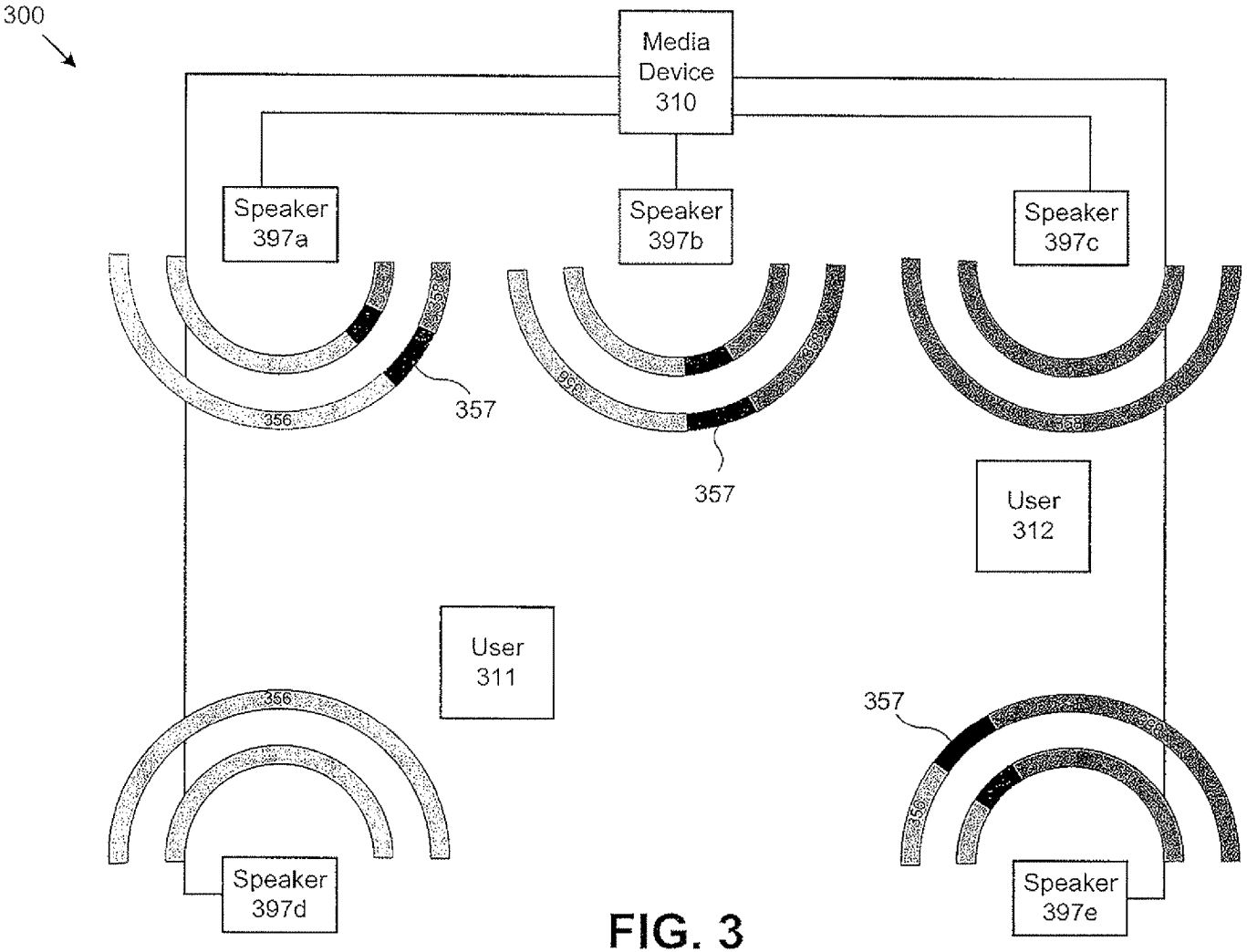
FIG. 3 illustrates another exemplary environment utilizing the system of FIG. 1, according to one implementation of the present disclosure.

FIG. 3 illustrates exemplary environment 300 utilizing system 100 of FIG. 1, according to one implementation of the present disclosure. It should be noted that, to clearly show that audio is delivered to user 311 and user 312, FIG. 3 does not show user devices 205*a* and 205*b*. As shown in FIG. 3, user 311 is located at a first position and receives first audio content 356. User 312 is located at a second position and receives second audio content 358.

First audio content 356 may include dialog in a language selected by user 311 and may include other audio contents such as music and effects. In some implementations, user 311 may select an audio profile that is normal, where a normal audio profile refers to a selection that delivers audio to user 311 at levels unaltered from audio contents 107. Second audio content 358, may include dialog in a language selected by user 312 and may include other audio contents such as music and effects. In some implementations, user 312 may select an audio profile that is normal, where a normal audio profile refers to a selection that delivers audio portions to user 312 at levels unaltered from audio contents 107.

Each of speakers 397*a*-397*e* may transmit cancellation audio 357. Cancellation audio 357 may cancel a portion of an audio content transmitted by speaker 397*a*, speaker 397*b*, speaker 397*c*, speaker 397*d*, and speaker 397*e*. In some implementations, cancellation audio 357 may completely cancel a portion of first audio content 376 or a portion of second audio content 358. For example, when first audio 356 includes dialog in a first language and second audio 358 includes dialog in a second language, cancellation audio 357 may completely cancel the first language portion of first audio 356 so that user 312 receives only dialog in the second language. In some implementations, cancellation audio 357 may partially cancel a portion of first audio content 356 or second audio content 358. For example, when first audio 356 includes dialog at an increased level and in a first language, and second audio 358 includes dialog at a normal level in the first language, cancellation audio 357 may partially cancel the dialog portion of first audio 356 to deliver dialog at the appropriate level to user 312.

Figure 4:
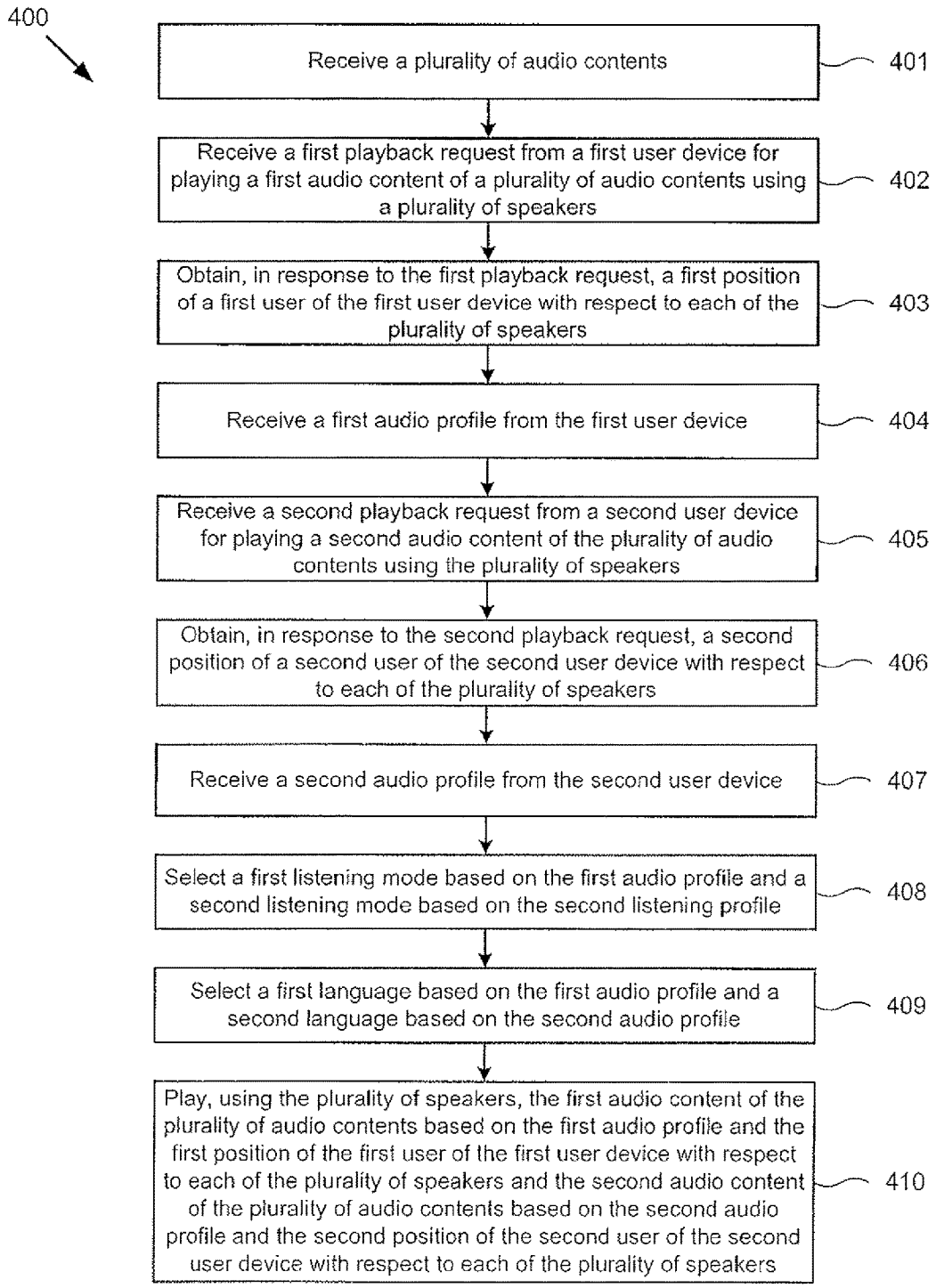
FIG. 4 illustrates an exemplary flowchart of a method for delivery of personalized audio, according to one implementation of the present disclosure.

FIG. 4 illustrates exemplary flowchart 400 of a method for delivery of a personalized audio, according to one implementation of the present disclosure. Beginning at 401, audio application receives audio contents 107. In some implementations, audio contents 107 may include a plurality of audio tracks, such as a music track, a dialog track, an effects track, an ambient sound track, a background sounds track, etc. In other implementations, audio contents 107 may include all of the audio associated with a media being played back to users in one audio track.

At 402, media device 110 receives a first playback request from a first user device for playing a first audio content of audio contents 107 using speakers 197. In some implementations, the first user device may be a smart phone, a tablet computer, or other handheld device including a microphone that is suitable for transmitting a playback request to media device 110 and receiving a calibration signal transmitted by media device 110. The first playback request may be a wireless signal transmitted from the first user device to media device 110. In some implementations, media device 110 may send a signal to user device 105 prompting the user to launch an application software on user device 105. The application software may be used in determining the position of user device 105, and the user may use the application software to select audio settings, such as language and audio profile.

At 403, media device 110 obtains a first position of a first user of the first user device with respect to each of the plurality of speakers, in response to the first playback request. In some implementations, user device 105 may include a calibration application for use with audio application 140. After initiation of the calibration application, user device 105 may receive a calibration signal from media device 110. The calibration signal may be an audio signal transmitted by a plurality of speakers, such as speakers 197, and user device 105 may use the calibration signal to determine the position of user device 105 relative to each speaker of speakers 197. In some implementations, user device 105 provides the position relative to each speaker to media device 110. In other implementations, user device 105, using the microphone of user device 105, may receive the calibration signal and transmit the information to media device 110 for processing. In some implementations, media device 110 may determine the position of user device 105 relative to speakers 197 based on the information received from user device 105.

The calibration signal transmitted by media device 110 may be transmitted using speakers 197. In some implementations, the calibration signal may be an audio signal that is audible to a human, such as an audio signal between about 20 Hz and about 20 kHz, or the calibration signal may be an audio signal that is not audible to a human, such as an audio signal having a frequency greater than about 20 kHz. To determine the position of user device 105 relative to each speaker of speakers 197, speakers 197*a*-197*n* may transmit the calibration signal at a different time, or speakers 197 may transmit the calibration signal at the same time. In some implementations, the calibration signal transmitted by each speaker of speakers 197 may be a unique calibration signal, allowing user device 105 to differentiate between the calibration signal emitted by each speaker 197*a*-197*n*. The calibration signal may be used to determine the position of user device 105 relative to speakers 197*a*-197*n*, and the calibration signal may be used to update the position of user device 105 relative to speakers 197*a*-197*n*.

In some implementations, speakers 197 may be wireless speakers, or speakers 197 may be mobile speakers that a user can reposition. Accordingly, the position of each speaker of speakers 197*a*-197*n* may change, and the distance between the speakers of speakers 197*a*-197*n* may change. The calibration signal may be used to determine the relative position of speakers 197*a*-197*n* and/or the distance between speakers 197*a*-197*n*. The calibration signal may be used to update the relative position of speakers 197*a*-197*n* and/or the distance between speakers 197*a*-197*n*.

Alternatively, system 100 may obtain, determine, and/or track the position of a user or a plurality of users using a camera. In some implementations, system 100 may include a camera, such as a digital camera. System 100 may obtain a position of user device 105, and then map the position of user device 105 to an image captured by the camera to determine a position of the user. In some implementations, system 100 may use the camera and recognition software, such as facial recognition software, to obtain a position of a user.

Once system 100 has obtained the position of a user, system 100 may use the camera to continuously track the position of the user and/or periodically update the position of the user. Continuously tracking the position of a user, or periodically updating the position of a user, may be useful because a user may move during the playback of audio contents 107. For example, a user who is watching a movie may change position after returning from getting a snack. By tracking and/or updating the position of the user, system 100 can continue to deliver personalized audio to the user throughout the duration of the movie. In some implementations, system 100 is configured to detect that a user or a user device has left the environment, such as a room, where the audio is being played. In response, system 100 may stop transmitting personalized audio corresponding to that user until that user returns to the room. System 100 may prompt a user to update the user's position if the user moves. To update the position of the user, media device 110 may transmit a calibration signal, for example, a signal at a frequency greater than 20 kHz, to obtain an updated position of the user.

Additionally, the calibration signal may be used to determine audio qualities of the room, such as the shape of the room and position of walls relative to speakers 197. System 100 may use the calibration signal to determine the position of the walls and how sound echoes in the room. In some implementations, the walls may be used as another sound source. As such, rather than cancelling out the echoes or in conjunction with cancelling out the echoes, the walls and their configurations may be considered for reducing or eliminating echoes. System 100 may also determine other factors that affect how sound travels in the environment, such as the humidity of the air.

At 404, media device 110 receives a first audio profile from the first user device. An audio profile may include a user preference determining the personalized audio delivered to the user. For example, an audio profile may include a language selection and/or a listening mode. In some implementations, audio contents 107 may include a dialog track in one language or a plurality of dialog tracks each in a different language. The user of user device 105 may select a language in which to hear the dialog track, and media device 110 may deliver personalized audio to the first user including dialog in the selected language. The language that the first user hears may include the original language of the media being played back, or the language that the first user hears may be a different language than the original language of the media being played back.

A listening mode may include settings designed to enhance the listening experience of a user, and different listening modes may be used for different situations. System 100 may include an enhanced dialog listening mode, a listening mode for action programs, drama programs, or other genre specific listening modes, a normal listening mode, and a custom listening mode. A normal listening mode may deliver the audio as provided in the original media content, and a custom listening mode may allow a user to specify portions of audio contents 107 to enhance, such as the music, dialog, and effects.

At 405, media device 110 receives a second playback request from a second user device for playing a second audio content of the plurality of audio contents using the plurality of speakers. In some implementations, the second user device may be a smart phone, a tablet computer, or other handheld device including a microphone that is suitable for transmitting a playback request to media device 110 and receiving a calibration signal transmitted by media device 110. The second playback request may be a wireless signal transmitted from the second user device to media device 110.

At 406, media device 110 obtains a position of a second user of a second user device with respect to each of the plurality of speakers, in response to the second playback request. In some implementations, the second user device may include a calibration application for use with audio application 140. After initiation of the calibration application, the second user device may receive a calibration signal from media device 110. The calibration signal may be an audio signal transmitted by a plurality of speakers, such as speakers 197, and the second user device may use the calibration signal to determine the position of user device 105 relative to each speaker of speakers 197. In some implementations, the second user device may provide the position relative to each speaker to media device 110. In other implementations, the second user device may transmit information to media device 110 related to receiving the calibration signal, and media device 110 may determine the position of the second user device relative to speakers 197.

At 407, media device 110 receives a second audio profile from the second user device. The second audio profile may include a second language and/or a second listening mode. After receiving the second audio profile, at 408, media device 110 selects a first listening mode based on the first audio profile and a second listening mode based on the second listening profile. In some implementations, the first listening mode and the second listening mode may be the same listening mode, or they may be different listening modes. Continuing with 409, media device 110 selects a first language based on the first audio profile and a second language based on the second audio profile. In some implementations, the first language may be the same language as the second language, or the first language may be a different language than the second language.

At 410, system 100 plays the first audio content of the plurality of audio contents based on the first audio profile and the first position of the first user of the first user device with respect to each of the plurality of speakers. The system 100 plays the second audio content of the plurality of audio contents based on the second audio profile and the second position of the second user of the second user device with respect to each of the plurality of speakers. In some implementations, the first audio content of the plurality of audio contents being played by the plurality of speakers may include a first dialog in a first language, and the second audio content of the plurality of audio contents being played by the plurality of speakers may include a second dialog in a second language The first audio content may include a cancellation audio that cancels at least a portion of the second audio content being played by speakers 197. In some implementations, the cancellation audio may partially cancel or completely cancel a portion of the second audio content being played by speakers 197. To verify the effectiveness of the cancellation audio, system 100, using user device 105, may prompt the user to indicate whether the user is hearing audio tracks they should not be hearing, e.g., is the user hearing dialog in a language other than the selected language. In some implementations, the user may be prompted to give additional subjective feedback, i.e., whether the music is at a sufficient volume.

From the above description, it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A media device for use in a system including a plurality of speakers, the media device comprising:

a memory configured to store a software application; and a processor configured to execute the software application to:

transmit one or more audio calibration signals to the plurality of speakers for emission of sounds by the plurality of speakers in an environment;

receive, from a user device, information relating to a detection of the sounds emitted by the plurality of speakers and detected by the user device;

analyze the information received from the user device to determine positions of the plurality of speakers in the environment;

detect a position of a user of the user device in the environment;

create one or more virtual speakers to deliver personalized audio to the user using the plurality of speakers based on the positions of the plurality of speakers and the position of the user, by causing an interference between audio signals transmitted from two or more of the plurality of speakers, such that the interference creates a sound appearing to originate from a location where none of the plurality of speakers is present;

track the position of the user while delivering the personalized audio to the user; and adjust the delivery of the personalized audio to the user based on the tracked position of the user and the positions of the plurality of speakers.

2. The media device of claim 1, wherein the processor is further configured to execute the software application to analyze the information to determine how the sounds travel in the environment.

3. The media device of claim 2, wherein the processor is further configured to determine echoes in the environment, and provide different audio signals to each of the plurality of speakers to cancel the echoes after determining how the sounds travel in the environment.

4. The media device of claim 1, wherein the processor is configured to transmit a same one or more audio calibration signals to each of the plurality of speakers for emission.

5. The media device of claim 1, wherein when tracking the user determines that the user has left the environment, the processor is further configured to stop the delivery of the personalized audio to the user using the plurality of speakers.

6. The media device of claim 1, wherein the processor is configured to analyze the information received from the user device to determine positions of walls in the environment, and wherein the processor is further configured to provide different audio signals to each of the plurality of speakers after determining the positions of walls in the environment.

7. The media device of claim 1, wherein detecting the position of the user includes and is based on determining a position of the user device.

8. The media device of claim 2, wherein the processor is further configured to provide a different level of audio signals to each of the plurality of speakers after determining how the sounds travel in the environment.

9. The media device of claim 1, wherein transmitting the one or more audio calibration signals includes:

transmitting first one or more audio calibration signals to a first speaker of the plurality of speakers for emission by the first speaker; and transmitting second one or more audio calibration signals to a second speaker of the plurality of speakers for emission by the second speaker;

wherein the first one or more audio calibration signals are different than the second one or more audio calibration signals.

10. The media device of claim 1, wherein transmitting the one or more audio calibration signals includes:

transmitting the one or more audio calibration signals to a first speaker of the plurality of speakers at a first time; and transmitting the one or more audio calibration signals to a second speaker of the plurality of speakers at a second time;

wherein the first time is different than the second time.

11. A method for use by a media device in a system including a plurality of speakers, the media device having a memory storing a software application and a processor executing the software application to perform the method comprising:

transmitting, using the processor executing the software application, the one or more audio calibration signals to the plurality of speakers for emission of sounds by the plurality of speakers in an environment;

receiving, using the processor executing the software application, from a user device, information relating to a detection of the sounds emitted by the plurality of speakers and detected by the user device;

analyzing, using the processor executing the software application, the information received from the user device to determine positions of the plurality of speakers in the environment;

detecting a position of a user of the user device in the environment;

creating one or more virtual speakers to deliver personalized audio to the user using the plurality of speakers based on the positions of the plurality of speakers and the position of the user, by causing an interference between audio signals transmitted from two or more of the plurality of speakers, such that the interference creates a sound appearing to originate from a location where none of the plurality of speakers is present;

tracking the position of the user while delivering the personalized audio to the user; and adjusting the delivery of the personalized audio to the user based on the tracked position of the user and the positions of the plurality of speakers.

12. The method of claim 11 further comprises analyzing the information to determine how the sounds travel in the environment.

13. The method of claim 12 further comprises determining echoes in the environment, and providing different audio signals to each of the plurality of speakers to cancel the echoes after determining how the sounds travel in the environment.

14. The method of claim 11, wherein the transmitting transmits a same one or more audio calibration signals to each of the plurality of speakers for emission.

15. The method of claim 11, wherein when tracking the user determines that the user has left the environment, the method further comprises stopping the delivery of the personalized audio to the user using the plurality of speakers.

16. The method of claim 11 further comprises analyzing the information received from the user device to determine positions of walls in the environment, and providing different audio signals to each of the plurality of speakers after determining the positions of walls in the environment.

17. The method of claim 11, wherein the detecting of the position of the user includes and is based on determining a position of the user device.

18. The method of claim 12 further comprises providing a different level of audio signals to each of the plurality of speakers after determining how the sounds travel in the environment.

19. The method of claim 11, wherein transmitting the one or more audio calibration signals includes:

transmitting first one or more audio calibration signals to a first speaker of the plurality of speakers for emission by the first speaker; and transmitting second one or more audio calibration signals to a second speaker of the plurality of speakers for emission by the second speaker;

wherein the first one or more audio calibration signals are different than the second one or more audio calibration signals.

20. The method of claim 11, wherein transmitting the one or more audio calibration signals includes:

transmitting the one or more audio calibration signals to a first speaker of the plurality of speakers at a first time; and transmitting the one or more audio calibration signals to a second speaker of the plurality of speakers at a second time;

wherein the first time is different than the second time.

* * * * *